US010681461B2

(12) United States Patent
Fukushima et al.

(10) Patent No.: US 10,681,461 B2
(45) Date of Patent: Jun. 9, 2020

(54) HEADPHONE

(71) Applicant: Pioneer DJ CORPORATION, Yokohama-shi, Kanagawa (JP)

(72) Inventors: Ryusuke Fukushima, Yokohama (JP); Kazunori Kakiyama, Yokohama (JP)

(73) Assignee: ALPHATHETA CORPORATION, Yokohama-Shi (JP)

( * ) Notice: Subject to any disclaimer, the term of this patent is extended or adjusted under 35 U.S.C. 154(b) by 0 days.

(21) Appl. No.: 16/338,563

(22) PCT Filed: Oct. 4, 2016

(86) PCT No.: PCT/JP2016/079509
§ 371 (c)(1),
(2) Date: Apr. 1, 2019

(87) PCT Pub. No.: WO2018/066071
PCT Pub. Date: Apr. 12, 2018

(65) Prior Publication Data
US 2019/0238984 A1 Aug. 1, 2019

(51) Int. Cl.
*H04R 25/00* (2006.01)
*H04R 5/033* (2006.01)
*H04R 1/10* (2006.01)

(52) U.S. Cl.
CPC ..... *H04R 5/0335* (2013.01); *H04R 1/10* (2013.01); *H04R 1/1008* (2013.01); *H04R 1/1041* (2013.01); *H04R 1/1066* (2013.01)

(58) Field of Classification Search
CPC combination set(s) only.
See application file for complete search history.

(56) References Cited

U.S. PATENT DOCUMENTS

2011/0103635 A1 5/2011 Asakura et al.
2012/0230532 A1* 9/2012 Howell ..... H04R 1/1066 381/381
2016/0198254 A1 7/2016 Gecawicz et al.
2016/0269814 A1 9/2016 Rye
2017/0055079 A1* 2/2017 Yang ..... H04R 1/1008

FOREIGN PATENT DOCUMENTS

JP 2008-205585 9/2008
JP 2010-041632 2/2010
JP 2011-055177 3/2011
JP 2016-005058 1/2016

OTHER PUBLICATIONS

English translation of International Preliminary Report on Patentability dated Apr. 9, 2019 (Apr. 9, 2019), Application No. PCT/JP2016/079509, 4 pages.
International Search Report, dated Nov. 8, 2016 (Nov. 8, 2016), 1 page.
European Search Report dated Feb. 13, 2020, 7 pages.

* cited by examiner

*Primary Examiner* — Amir H Etesam
(74) *Attorney, Agent, or Firm* — Rankin, Hill & Clark LLP

(57) ABSTRACT

A headphone includes: a headband; at least one sound-emitting unit including a sound emitter located therein; at least one connector connecting the sound-emitting unit to the headband such that the sound-emitting unit is rotatable around a rotation axis along an up-down direction, and at least one adjuster configured to adjust a rotation range of the sound-emitting unit.

10 Claims, 13 Drawing Sheets

HEADPHONE

TECHNICAL FIELD

The present invention relates to a headphone.

BACKGROUND ART

A known typical headphone is worn on the user's head, covering the user's right and left ears. A known example of such a headphone includes: a pair of housings being placed on the right and left ears; a headband being placed on the head; and connectors provided to ends of the headband, the housings each being rotatably connected to corresponding one of the connectors (see, for instance, Patent Literature 1).

The pair of housings of the headphone disclosed in Patent Literature 1 each include a body containing a speaker unit and a hanger supporting the body. Respective sound-emitting surfaces of the bodies of the housings, which face each other when the headphone is in a normal use state, can be directed rearward by oppositely rotating the housings. In other words, the housings of the headphone are rotatable by 90 degrees with respect to the normal use state.

CITATION LIST

Patent Literature(S)

Patent Literature 1 JP 2016-5058 A

SUMMARY OF THE INVENTION

Problem(s) to be Solved by the Invention

Some users, such as DJ (Disc Jockey), often use a headphone in a different manner than ordinary users. For instance, due to the necessity of separately monitoring music currently playing on site and music being played next, a DJ sometimes listens to the music currently playing on site with one of his/her ears while monitoring the music being played next with the other ear. In this case, for instance, the DJ sometimes wears a headphone, putting one of the right and left housings to his/her ear while holding the other housing with his/her chin or the like or putting the other housing to the back of his/her head.

However, rotation of the housings of the headphone disclosed in Patent Literature 1 is restrictable merely at two positions such as a position corresponding to the normal use state and a 90-degree rotation position relative to the position corresponding to the normal use state. Thus, the other housing is unlikely to be stably held with the user's chin or the like or put to the back of the user's head, since the other housing is rotated more than necessary. In view of the above, the headphone disclosed in Patent Literature 1 has a problem of being difficult to stably wear.

Meanwhile, a rotation range of the housings may be set smaller than 90 degrees. However, in this case, a thickness (depth) of the headphone is less reducible. As a result, the headphone would require a larger storing space.

In view of the above problems, an object of the invention is to provide a more user-friendly headphone.

Means for Solving the Problem(s)

According to a first aspect of the invention, a headphone includes: a headband; at least one sound-emitting unit including a sound emitter located therein; at least one connector connecting the sound-emitting unit to the headband such that the sound-emitting unit is rotatable around a rotation axis along an up-down direction; and at least one adjuster configured to adjust a rotation range of the sound-emitting unit.

According to a second aspect of the invention, a headphone includes: a headband; a sound-emitting unit including a sound emitter located therein; a connector provided to the headband, the connector supporting the sound-emitting unit such that the sound-emitting unit is rotatable around a rotation axis along an up-down direction; and an adjuster configured to adjust a position where rotation of the sound-emitting unit is restricted.

BRIEF DESCRIPTION OF DRAWING(S)

Figure 6:
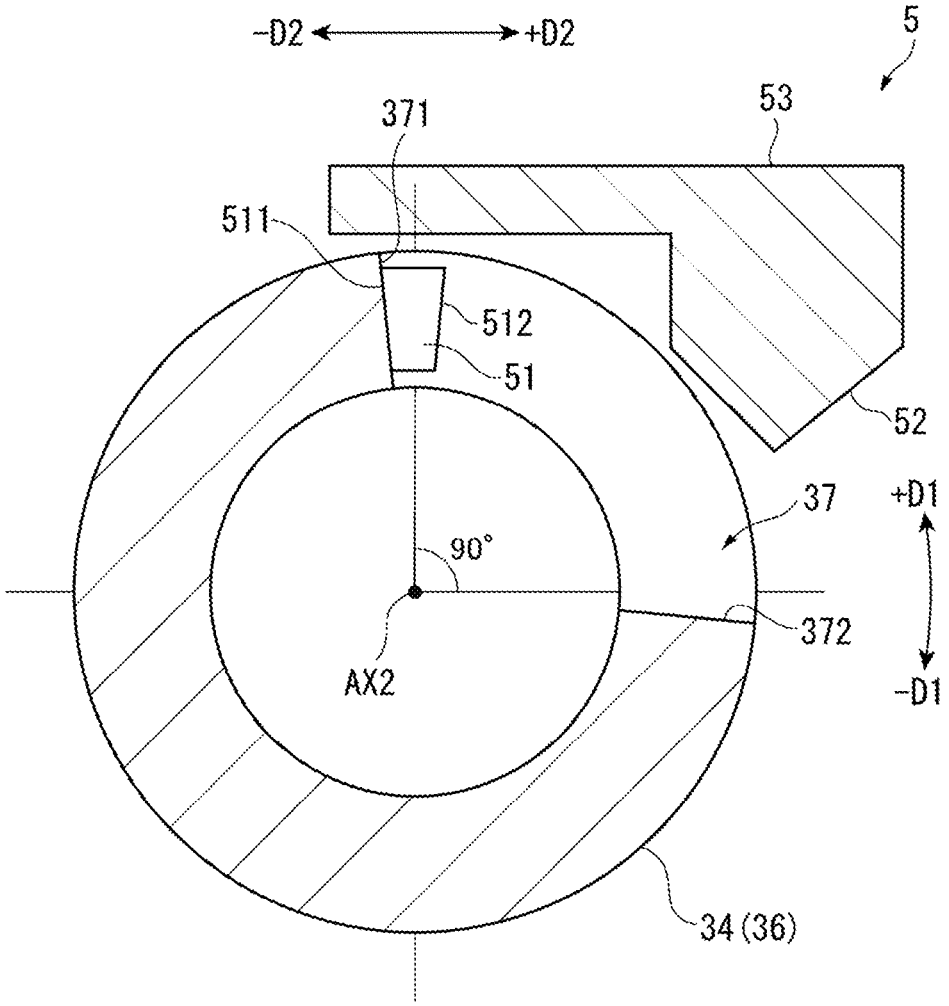

FIG. 6 schematically shows the adjuster with the sound-emitting unit being at the reference position according to the first exemplary embodiment.

Figure 7:
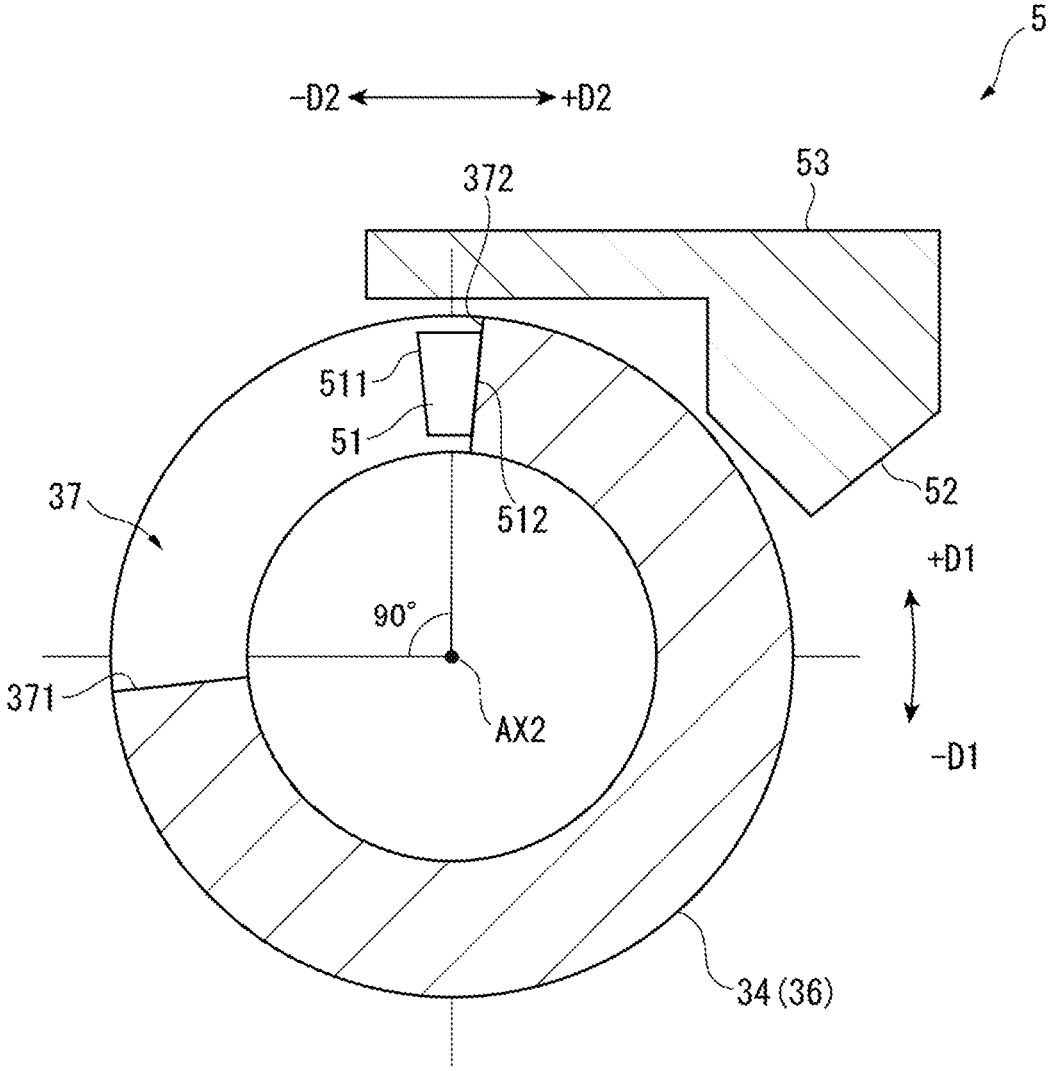

FIG. 7 schematically shows the adjuster with the sound-emitting unit being at the first restricting position according to the first exemplary embodiment.

Figure 8:
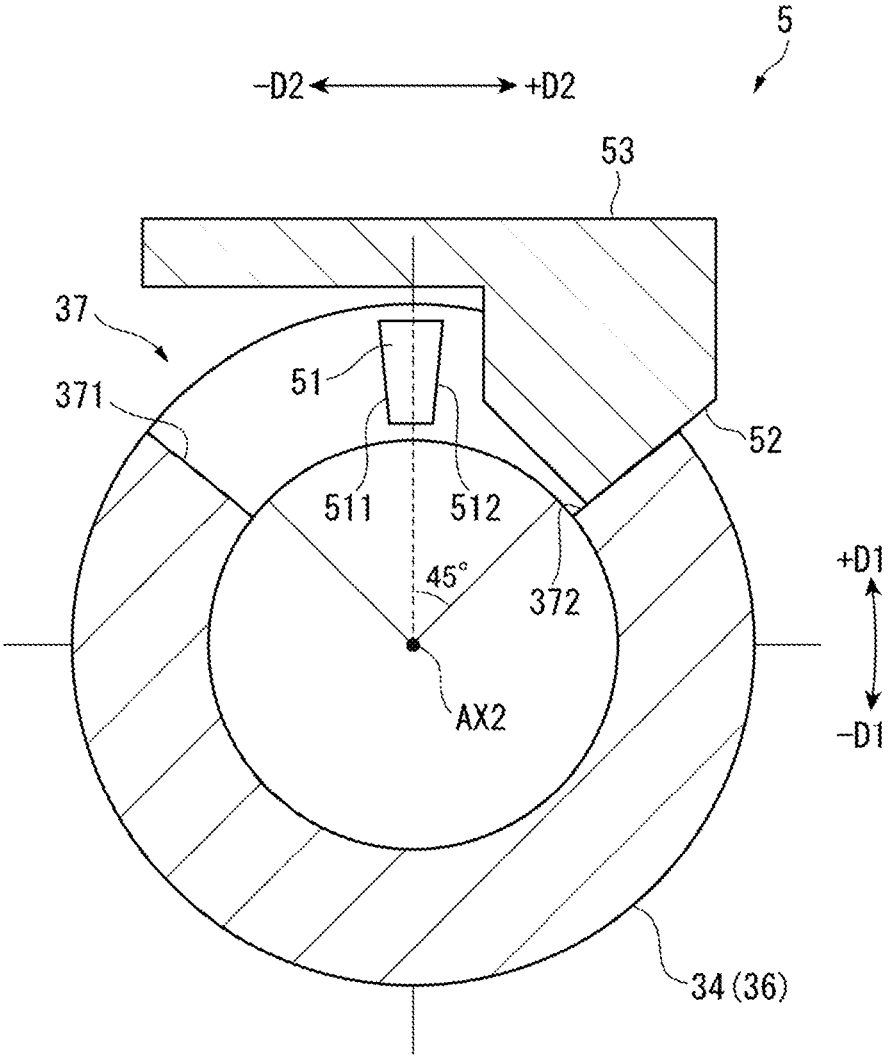

FIG. 8 schematically shows the adjuster with the sound-emitting unit being at the second restricting position according to the first exemplary embodiment.

Figure 9:
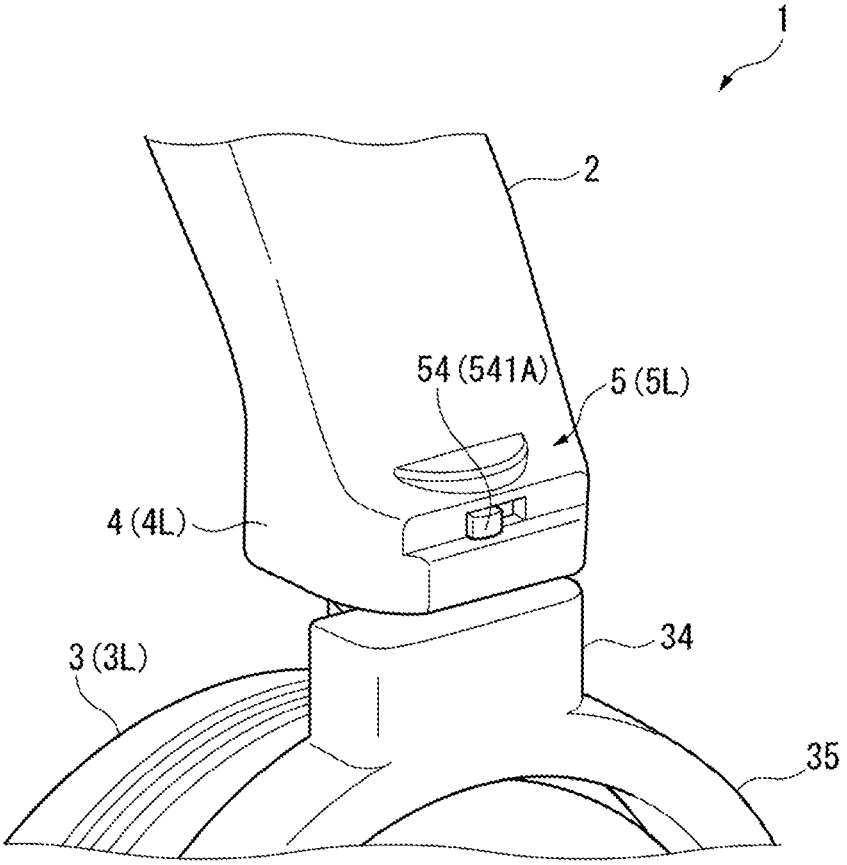

FIG. 9 is a perspective view showing another operation unit according to the first exemplary embodiment.

Figure 10:
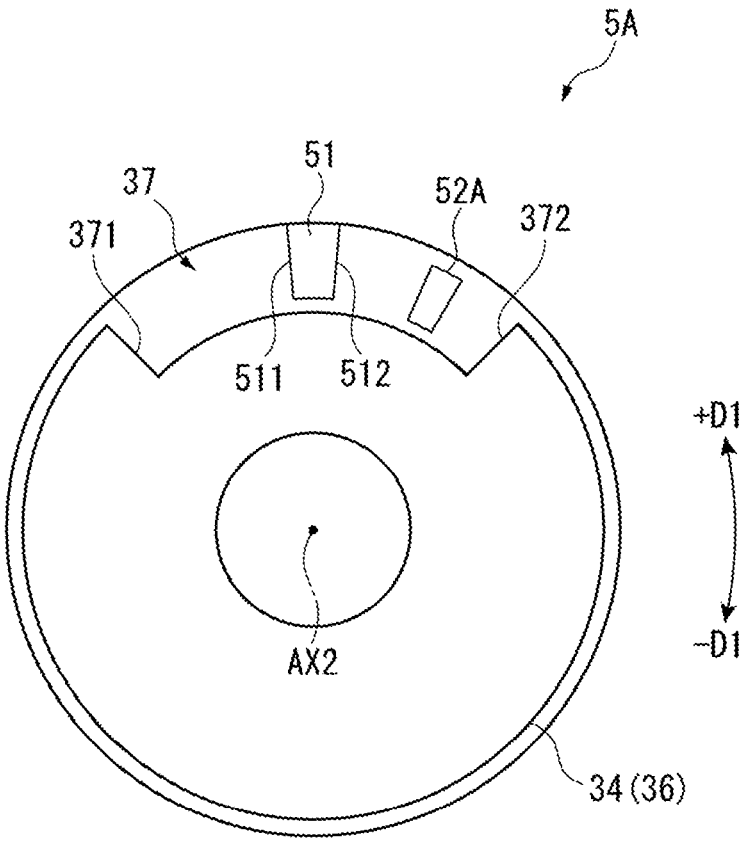

FIG. 10 schematically shows a structure of an adjuster and a rotation range of a shaft of a headphone according to a second exemplary embodiment of the invention.

Figure 11:
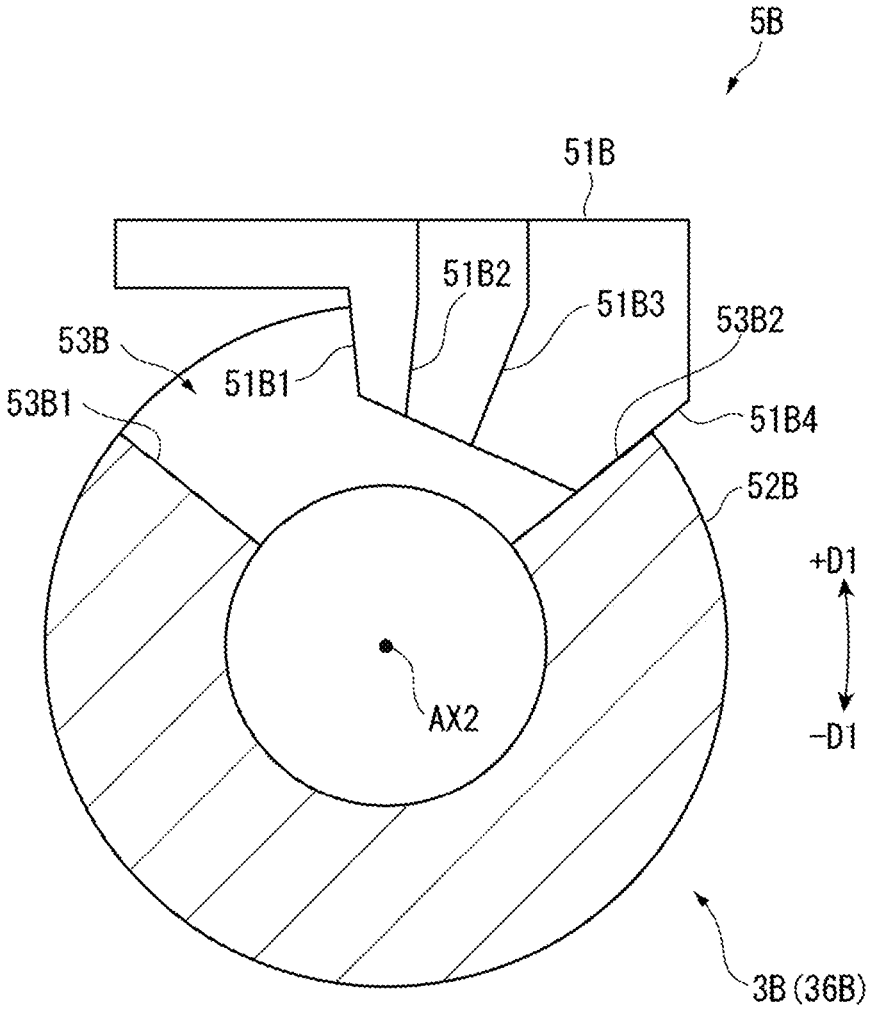

FIG. 11 schematically shows a sound-emitting unit and an adjuster of a headphone according to a third exemplary embodiment of the invention.

Figure 12:
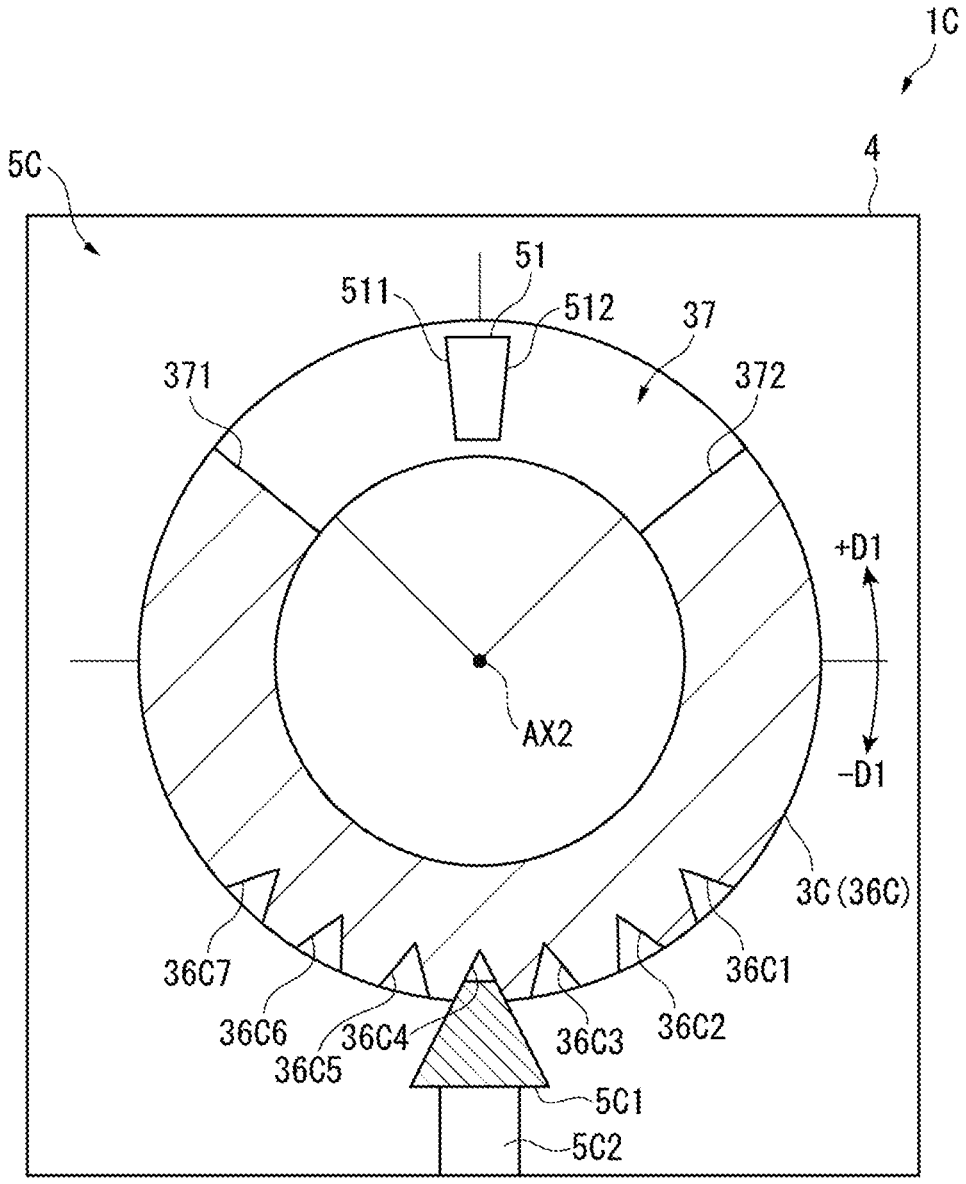

FIG. 12 schematically shows a sound-emitting unit and an adjuster of a headphone according to a fourth exemplary embodiment of the invention.

Figure 13:
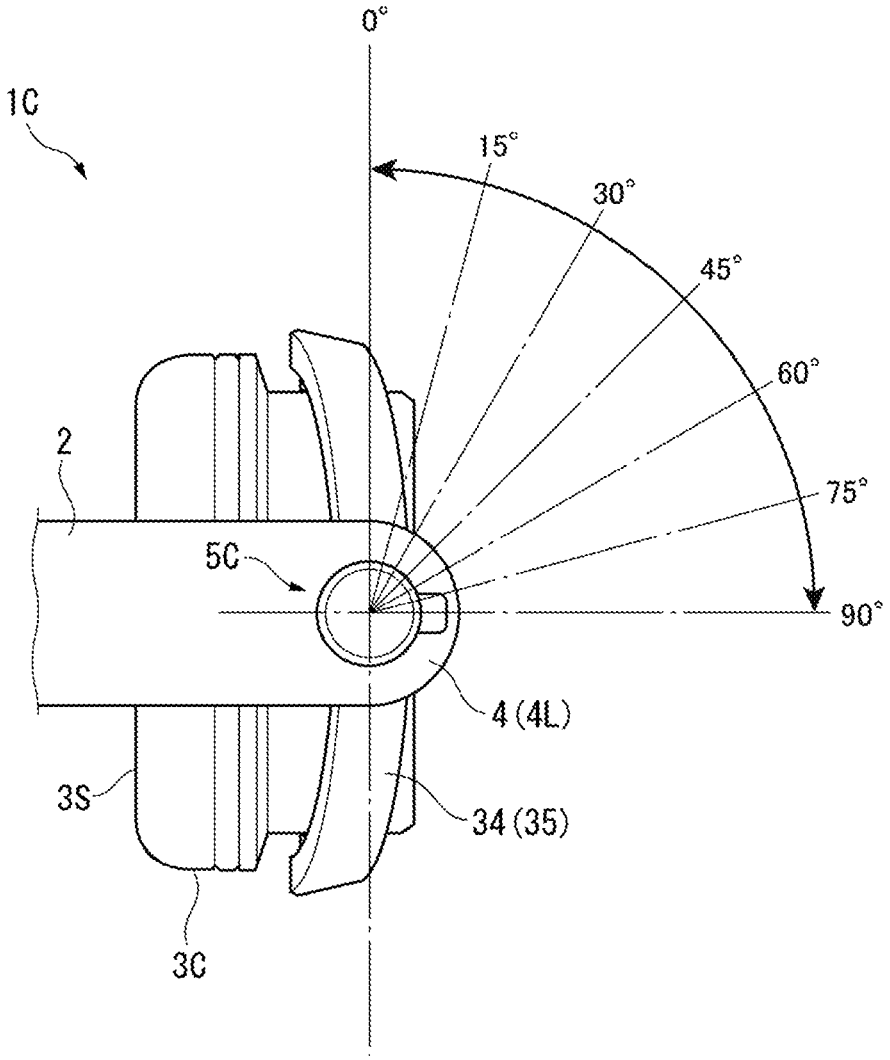

FIG. 13 shows a rotation state of the sound-emitting unit according to the fourth exemplary embodiment as viewed from above.

DESCRIPTION OF EMBODIMENT(S)

First Exemplary Embodiment

A first exemplary embodiment of the invention will be described with reference to the attached drawings.

Overall Structure of Headphone

Figure 1:
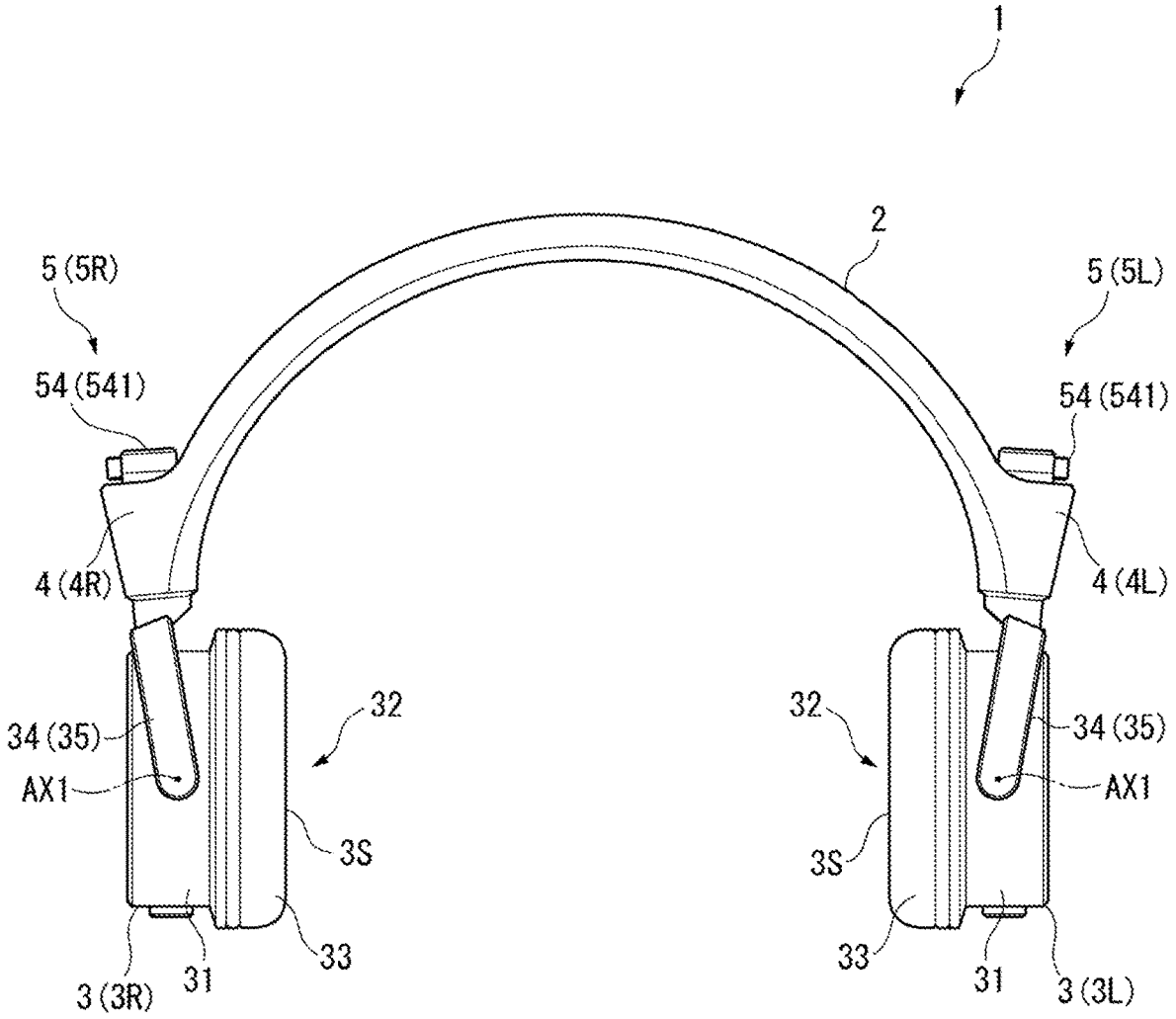
FIG. 1 is a front view showing a headphone according to a first exemplary embodiment of the invention.

FIG. 1 is a front view showing a headphone 1 according to the first exemplary embodiment.

The headphone 1 according to the first exemplary embodiment is configured to be worn on the user's head and output sound to the user's ears. As shown in FIG. 1, the headphone 1 includes a headband 2, two sound-emitting units 3 (3L, 3R), two connectors 4 (4L, 4R), and two adjusters 5 (5L, 5R).

It should be noted that "front" and "rear" hereinbelow refer to front and rear with respect to a user who wears the headphone 1. Likewise, "up" and "down" refer to up and down with respect to the user and "right" and "left" refer to right and left with respect to the user.

A feature of the headphone 1 according to the first exemplary embodiment is that each of the sound-emitting units 3 is supported by the corresponding connector 4 to be rotatable around a rotation axis along an up-down direction and each of the adjusters 5 is provided to the corresponding connector 4 to adjust a rotation range of the corresponding sound-emitting unit 3.

Figure 2:
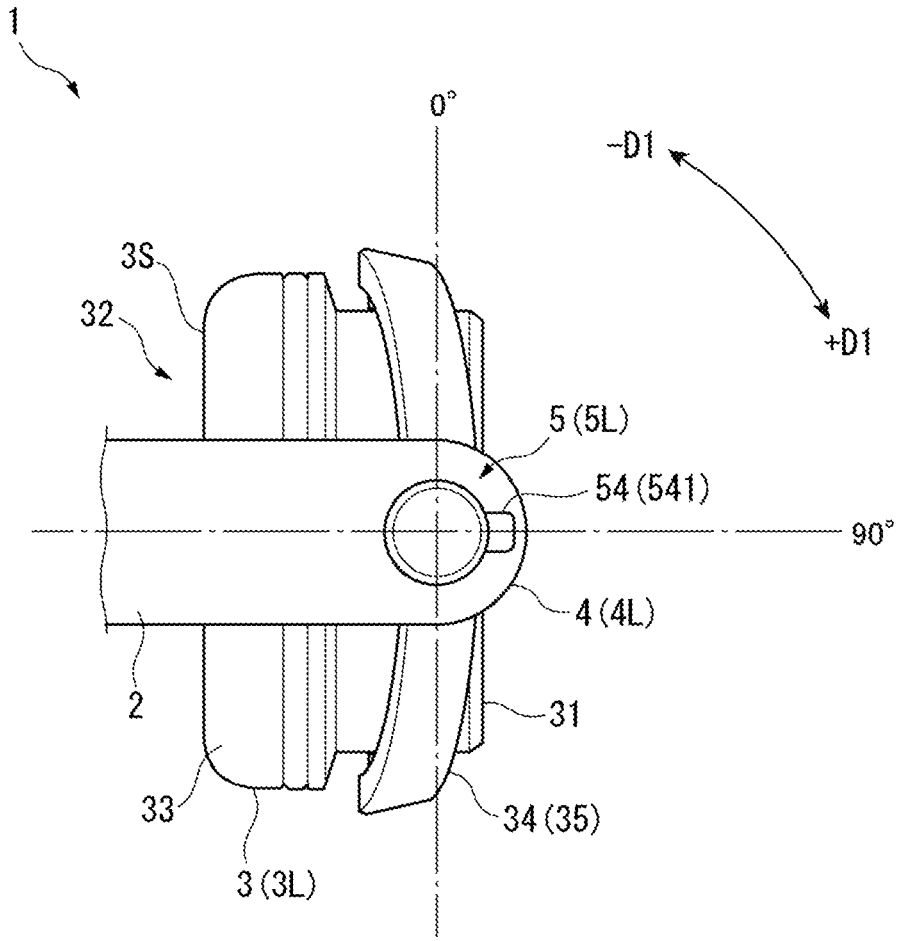
FIG. 2 shows a sound-emitting unit at a reference position according to the first exemplary embodiment as viewed from above.
Figure 3:
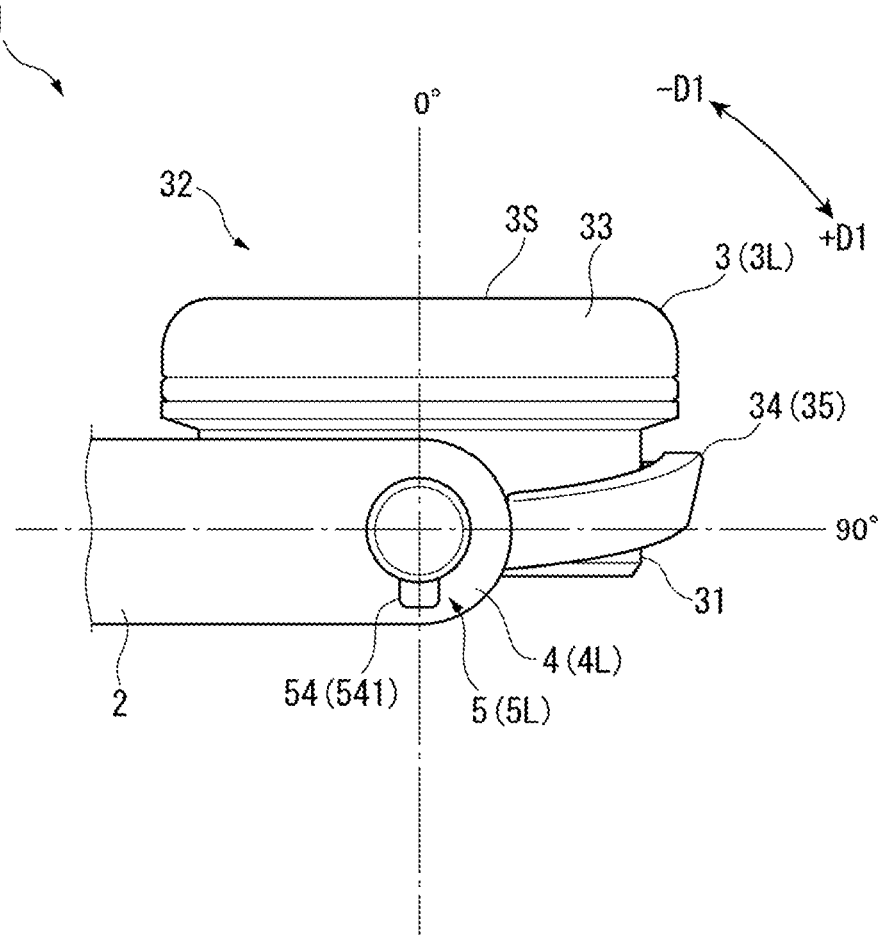
FIG. 3 shows the sound-emitting unit at a first restricting position according to the first exemplary embodiment as viewed from above.
Figure 4:
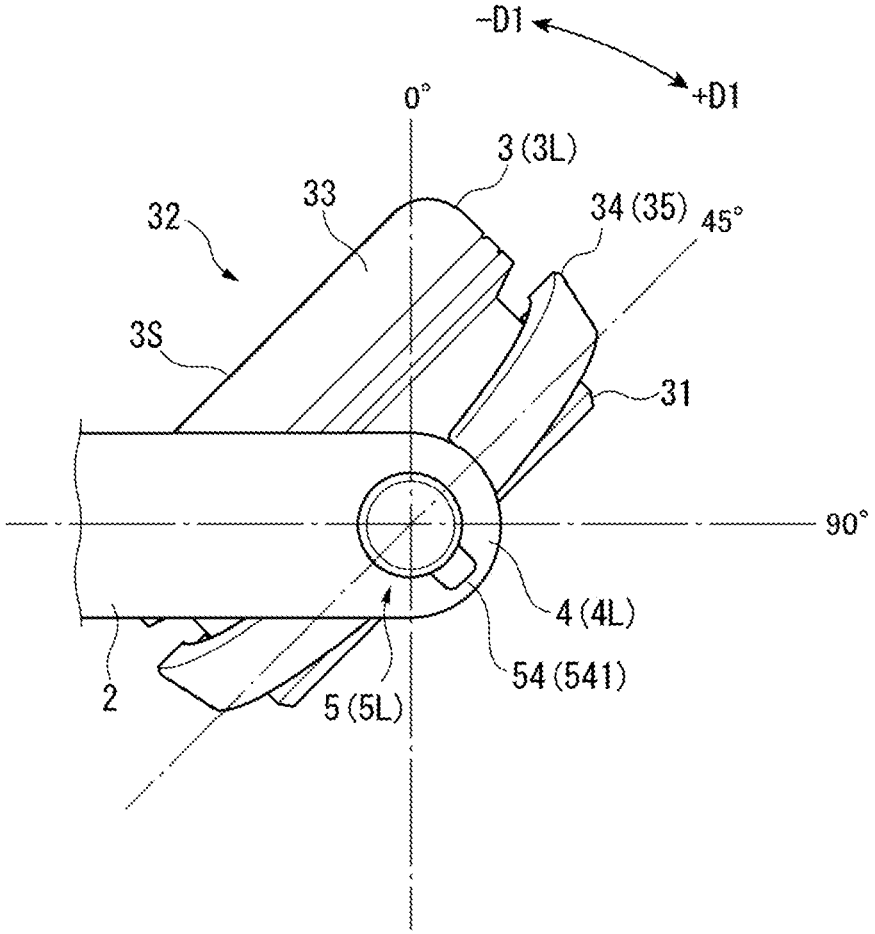
FIG. 4 shows the sound-emitting unit at a second restricting position according to the first exemplary embodiment as viewed from above.

FIG. 2 shows one of the sound-emitting units 3 at a reference position as viewed from above. FIG. 3 shows the sound-emitting unit 3 at a first restricting position as viewed from above. FIG. 4 shows the sound-emitting unit 3 at a second restricting position as viewed from above.

Specifically, each of the sound-emitting units 3 is rotatably supported by the corresponding connector 4. As shown in FIG. 2, the sound-emitting units 3 are each at the reference position (a position of each of the sound-emitting units 3 shown in FIG. 1) with respective sound-emitting surfaces 3S of the sound-emitting units 3 facing each other when the headphone 1 is in a state for normal use, and are each rotatable within a range of 90 degrees or less (first rotation range) from the reference position, which is defined as 0 degrees, to the first restricting position where the sound-emitting units 3 each face rearward. Further, each of the adjusters 5 is configured to switch the rotation range of the corresponding sound-emitting unit 3 to a range of 45 degrees or less (second rotation range) from the reference position to the second restricting position. The facing direction and restricting position of each of the sound-emitting units 3 can thus be adjusted depending on the state of use of the headphone 1.

Components of the headphone 1 will be described below.

Structure of Headband

The headband 2 is an arched member wearable on the head as shown in FIG. 1. The headband 2 is arched from the sound-emitting unit 3L corresponding to the left ear and the sound-emitting unit 3R corresponding to the right ear. A left end of the headband 2 is provided with the connector 4L connecting the left end to the sound-emitting unit 3L and a right end of the headband 2 is provided with the connector 4R connecting the right end to the sound-emitting unit 3R.

It should be noted that an extension/retraction mechanism capable of extension and retraction along the arched shape of the headband 2 may be provided near each of the right and left ends of the headband 2.

Structure of Sound-Emitting Unit

The pair of sound-emitting units 3 (right and left sound-emitting units are denoted by 3R and 3L, respectively) are configured to output a sound corresponding to an inputted audio signal. Specifically, the left sound-emitting unit 3L is located to be able to cover the left ear and the right sound-emitting unit 3R is located to be able to cover the right ear. The sound-emitting units 3 each include a housing 31, a speaker 32 (sound emitter), a pad 33, and a hanger 34.

The housing 31, which is cylindrical, contains the speaker 32. The housing 31 is supported by the hanger 34 to be vertically rotatable around a rotation axis AX1 along a front-rear direction. It should be noted that one of the right and left housings 31 is provided with an input cord (not shown) connected to an acoustic device. The acoustic device outputs audio signal for the left ear and audio signal for the right ear, one of which is inputting to the speaker 32 in corresponding one of the housings 31 through the input cord. Meanwhile, the other audio signal is inputted to the speaker 32 in the other housing 31 through a signal wire (not shown) in the headband 2. It should be noted that the audio signal(s) may be wirelessly received without using the input cord.

The pad 33 is attached to a sound-emitting surface, or a part facing the user's head, of the housing 31. The pad 33 may be made of a material with cushioning properties (e.g., low-resilience urethane) to be fitted well on the head when the pad 33 is in contact with the head.

The hanger 34 supports the housing 31 while being supported by the corresponding connector 4. The hanger 34 includes a support 35 and a shaft 36 (see FIG. 5).

The support 35 is arched to be semispherical along a circumferential direction of the corresponding housing 31. The support 35 has opposite ends supporting diametrally opposite ends of the housing 31. The housing 31 is thus supported by the hanger 34 to be vertically rotatable around the rotation axis AX1 defined along a horizontal direction as described above. The support 35 is inclined at a predetermined angle with respect to an up-down direction as viewed from the front side of the headphone 1.

Figure 5:
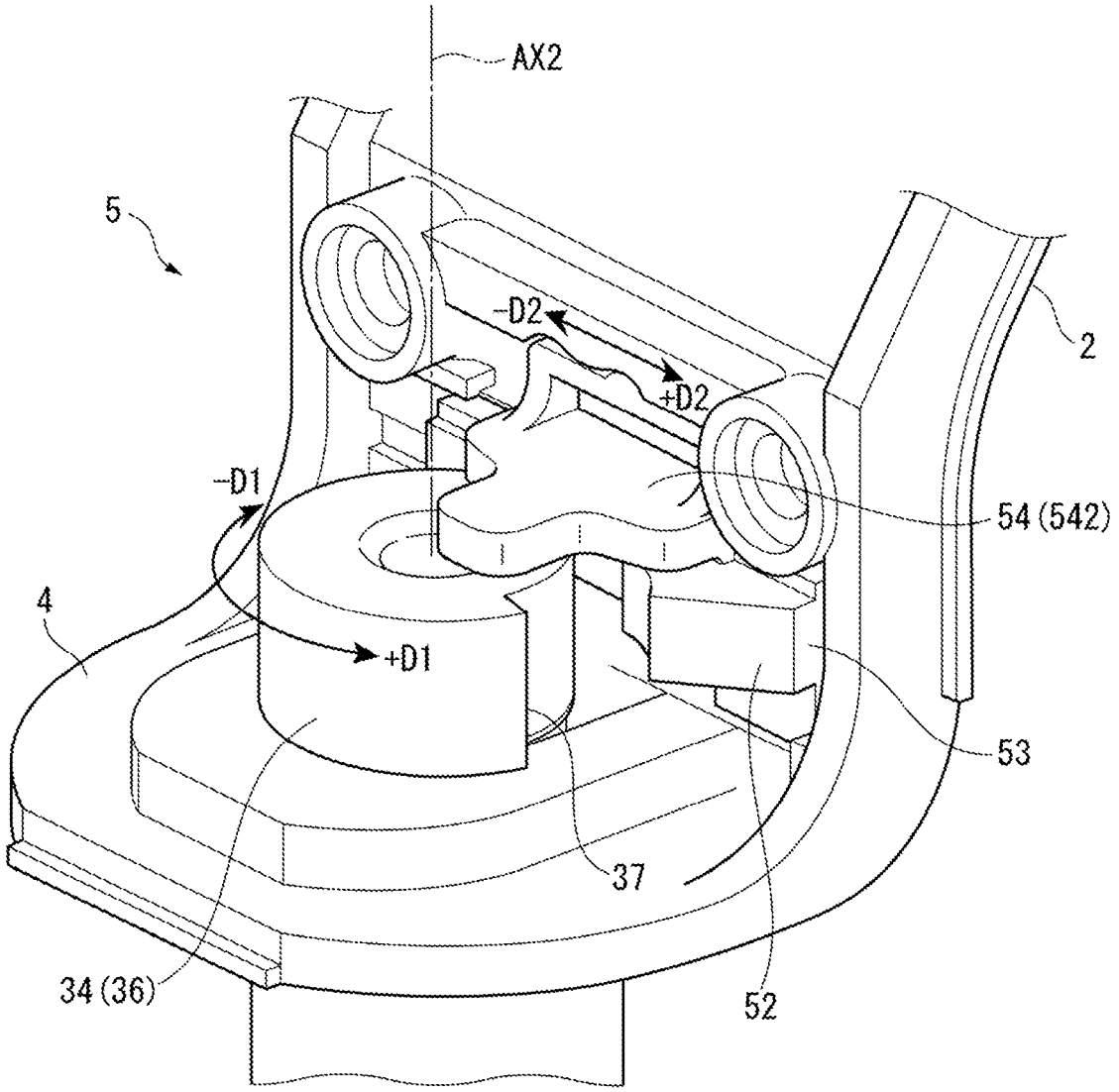
FIG. 5 is a perspective view showing a part of a shaft and an adjuster according to the first exemplary embodiment.

FIG. 5 is a perspective view showing a part of the shaft 36 and the later-described adjuster 5.

The shaft 36 projects upward from the support 35 to be rotatably supported by the corresponding connector 4. When the hanger 34 is supported by the corresponding connector 4, a center axis of the shaft 36 is aligned with the up-down direction. As shown in FIG. 5, the shaft 36 has an end (an end opposite the support 35) provided with a recess 37 that is formed along a circumferential direction of the shaft 36.

A fixed setting unit 51 (not shown in FIG. 5) of the later-described adjuster 5 is located in the recess 37. Additionally, a movable setting unit 52 of the adjuster 5 is positioned in the recess 37 depending on the state of use of the headphone 1.

Structure of Connector

The pair of connectors 4 (right and left connectors are denoted by 4R and 4L, respectively) are provided to the right and left ends of the headband 2 as shown in FIG. 1, respectively. The connectors 4 each connect the headband 2 to the hanger 34 of the corresponding sound-emitting unit 3. Specifically, the shaft 36 of the sound-emitting unit 3L is rotatably supported by the connector 4L and the shaft 36 of the sound-emitting unit 3R is rotatably supported by the connector 4R. The connectors 4 each receive therein an end of the corresponding shaft 36, while being provided with the corresponding adjuster 5.

Structure of Adjuster

FIG. 6 is a schematic view of each of the adjusters 5 with the corresponding sound-emitting unit 3 being at the reference position, showing that a first edge 371 of the recess 37 is in contact with the fixed setting unit 51 of the adjuster 5 while the movable setting unit 52 is retracted from the recess 37.

The adjusters 5 (right and left adjusters are denoted by 5R and 5L, respectively) are each engaged with the corresponding shaft 36, adjusting a rotation range of the shaft 36 and, consequently, the rotation range of the corresponding sound-emitting unit 3. In the first exemplary embodiment, the adjusters 5 are each configured to switch the rotation range of the corresponding sound-emitting unit 3 to one of the first rotation range and the second rotation range. The adjusters 5 each include the fixed setting unit 51 (not shown in FIG.

5), the movable setting unit 52, a switcher 53, and an operation unit 54 (not shown in FIG. 6) as shown in FIGS. 5 and 6.

Structure of Fixed Setting Unit

The fixed setting unit 51, which is substantially in a trapezoidal shape as viewed in an axial direction of the shaft 36 as shown in FIG. 6, is located in the recess 37. As the shaft 36 is rotated, the fixed setting unit 51 is configured to come into contact with one of a first edge 371 and a second edge 372 of the recess 37 to restrict the further rotation of the shaft 36, thus defining the rotation range (first rotation range) of the shaft 36.

The fixed setting unit 51 includes a first fixed setting portion 511 and a second fixed setting portion 512 opposite to the first fixed setting portion 511.

The first fixed setting portion 511 is configured to come into contact with the first edge 371 of the recess 37. A position of the shaft 36 where the first fixed setting portion 511 is in contact with the first edge 371 is defined as a reference position. When the shaft 36 is at the reference position, the headphone 1 is in a state as shown in FIGS. 1 and 2, where the respective sound-emitting surface 3S of the sound-emitting units 3 face each other. In other words, the sound-emitting units 3 of the headphone 1 in this state each output sound in a direction toward corresponding one of the user's right and left ears. This state is hereinafter referred to as "normal use state".

FIG. 7 schematically shows each of the adjusters 5 with the corresponding sound-emitting unit 3 being at the first restricting position. Specifically, FIG. 7 schematically shows that the second edge 372 of the recess 37 is in contact with the second fixed setting portion 512. It should be noted that the movable setting unit 52 is retracted from the recess 37 in the state shown in FIG. 7.

The second fixed setting portion 512 is configured to define the rotation range (first rotation range) of the shaft 36 in conjunction with the first fixed setting portion 511. The second fixed setting portion 512 is configured to come into contact with the second edge 372 of the recess 37 as the shaft 36 is rotated by 90 degrees in a +D1 direction around a rotation axis AX2 from the reference position. The second fixed setting portion 512 restricts the shaft 36 from a rotation of 90 degrees or more, setting the shaft 36 at the first restricting position.

The headphone 1 is thus set in a state shown in FIG. 3, where the respective sound-emitting surfaces 3S of the sound-emitting units 3 face the same direction (the rear side in the first exemplary embodiment). The headphone 1 in this state is to be stored in a storing case or be carried. This state is hereinafter referred to as "storing state".

The headphone 1 is thus configured such that the hangers 34, or the sound-emitting units 3, are each rotatable within the rotation range (first rotation range) of 90 degrees from the state where the first edge 371 is in contact with the first fixed setting portion 511 to the state where the second edge 372 is in contact with the second fixed setting portion 512.

Structure of Movable Setting Unit

FIG. 8 schematically shows each of the adjusters 5 with the corresponding sound-emitting unit 3 being at the second restricting position. Specifically, FIG. 8 schematically shows that the movable setting unit 52 is in the recess 37.

As shown in FIGS. 6 to 8, the movable setting unit 52, which is integral with the switcher 53, is brought to a position where the movable setting unit 52 can come into contact with the second edge 372 as the switcher 53 is moved.

When the movable setting unit 52 is moved into the recess 37 as described above, the shaft 36 is rotatable within a rotation range (second rotation range) defined between the reference position and the position where the second edge 372 comes into contact with the movable setting unit 52. The position where the second edge 372 comes into contact with the movable setting unit 52 is defined as the second restricting position.

It should be noted that assuming that the reference position is defined as 0 degrees, a rotation angle of the shaft 36 allowing the second edge 372 to come into contact with movable setting unit 52 is 45 degrees according to the first exemplary embodiment. In other words, the second rotation range according to the first exemplary embodiment is from 0 degrees to 45 degrees (inclusive).

Structure of Switcher

The switcher 53 is a slide member that is movable using the operation unit 54 in a +D2 direction perpendicular to the center axis (rotation axis AX2) of the shaft 36 and a −D2 direction opposite to the +D2 direction. The movement of the switcher 53 in the +D2 direction causes the movable setting unit 52 (a part of the switcher 53) to be retracted out of the recess 37 as shown in FIGS. 6 and 7. The rotation range of the shaft 36 is thus defined to be the first rotation range. In contrast, the movement of the switcher 53 in the −D2 direction causes the movable setting unit 52 to enter the recess 37. The rotation range of the shaft 36 is thus defined to be the second rotation range.

Structure of Operation Unit

The operation unit 54 is a member configured to be operated by the user to move the switcher 53. The operation unit 54 includes a body 541 shown in FIG. 1 and an actuating portion 542 shown in FIG. 5.

The body 541, which is a dial configured to rotate coaxially with the shaft 36, is exposed outside to be operable by the user. It should be noted that the body 541 is configured to rotate independently of the shaft 36.

The actuating portion 542 is engaged with the switcher 53 to move the switcher 53 in the +D2 direction and the −D2 direction with the rotation of the body 541.

By operating the operation unit 54, the switcher 53, or the movable setting unit 52, is moved into/out of the recess 37, thus switching the rotation range of the shaft 36 to either one of the first rotation range and the second rotation range.

Another Structure of Operation Unit

FIG. 9 is a perspective view showing possible another structure of the operation unit 54 (body 541A).

It should be noted that the body 541 of the operation unit 54 in the form of a dial may be replaced by a body 541A in the form of a slide switch as shown in FIG. 9. In this case, the actuating portion 542 also causes the switcher 53 to slide in the +D2 direction and the −D2 direction with the sliding movement of the body 541A in corresponding one of opposite directions, thus switching the rotation range to the first rotation range or the second rotation range.

The bodies 541, 541A may be located at any position where the bodies 541, 541A are at least partly exposed outside. Specifically, as shown in FIGS. 1 and 9, the body 541 (541A) may be located at a portion of the connector 4 opposite to the user or located at a front or rear portion of the connector 4. Alternatively, the body 541 (541A) may be located on a surface of the connector 4 facing the user.

Effects of First Exemplary Embodiment

When the rotation range of each of the sound-emitting units 3 (3L, 3R) is switched to the first rotation range of 0 degrees to 90 degrees (inclusive), the respective sound-emitting surfaces 3S of the sound-emitting units 3 (3L, 3R) can be rotated to face the left and right ears. Additionally, by oppositely rotating the sound-emitting units 3 by 90 degrees, the respective sound-emitting surfaces 3S are rotated to face the same direction. The state of the headphone 1 is thus switched between the normal use state and the storing state. The headphone 1 in the storing state has a reduced thickness (a dimension in the front-rear direction) with improved storability and portability.

Meanwhile, when the user, such as a DJ, wears the headphone 1 in a state different from the normal use state with the rotation range of each of the sound-emitting units 3 being adjusted to the second rotation range, the headphone 1 can be put on the user with the sound-emitting units 3 being fitted well to the user's body. The user can thus be less disturbed by the sound-emitting units 3.

The headphone 1 can thus be worn with improved comfortableness.

As described above, each of the adjusters 5 can adjust the rotation range depending on the state of use of the headphone 1, thus improving the user-friendliness of the headphone 1.

Each of the adjusters 5 is configured to switch the rotation range of the corresponding shaft 36, or the rotation range of the corresponding sound-emitting unit 3, to one of the first rotation range (0 degrees to 90 degrees, inclusive) and the second rotation range (0 degrees to 45 degrees, inclusive) smaller than the first rotation range, which are defined with respect to the reference position being 0 degrees. This allows the rotation range of each of the sound-emitting units 3 to one of the first rotation range and the second rotation range to achieve the above effects.

Each of the adjusters 5 includes: the first fixed setting portion 511 configured to come into contact with the first edge 371 of the recess 37 of the shaft 36 of the corresponding sound-emitting unit 3 to define respective first ends of the first rotation range and the second rotation range; the second fixed setting portion 512 configured to come into contact with the second edge 372 to define a second end of the first rotation range; the movable setting unit 52 configured to come into contact with the second edge 372 to define a second end of the second rotation range; and the switcher 53 configured to move the movable setting unit 52 to switch the rotation range of the corresponding sound-emitting unit 3 to one of the first rotation range and the second rotation range. The above arrangement allows the rotation range of each of the sound-emitting units 3 to be switched to one of the first rotation range and the second rotation range by moving the movable setting unit 52 using the switcher 53. The rotation range can thus be reliably and easily switched.

The sound-emitting units 3 each include the shaft 36 along the rotation axis AX2 and an outer circumferential surface of the shaft 36 is provided with the recess 37 recessed radially inward. The first fixed setting portion 511 and the second fixed setting portion 512 are located in the recess 37 at positions where the first fixed setting portion 511 and the second fixed setting portion 512 are to come into contact with the first edge 371 and the second edge 372, respectively. Further, the movable setting unit 52 is moved into/out of the recess 37 by the switcher 53. The rotation range can thus be switched to the first rotation range by moving the movable setting unit 52 out of the recess 37. Additionally, the rotation range can be switched to the second rotation range by moving the movable setting unit 52 into the recess 37. A switching mechanism for the rotation range can thus be simplified.

The switcher 53 is the slide member configured to slide the movable setting unit 52 in the +D2 direction and the −D2 direction perpendicular to the rotation axis AX2 of the shaft 36. This arrangement allows the switcher 53 to slide, causing the movement of the movable setting unit 52 to switch the rotation range. With the use of the operation unit 54, which includes the body 541A in the form of a slide switch, to move the movable setting unit 52, the rotation range can be easily switched with a simplified switching structure for the rotation range.

The headphone 1 includes the sound-emitting units 3 (3R, 3L), the connectors 4 (4R, 4L), and the adjusters 5 (5R, 5L), which are located at right and left of the headband 2, respectively. Assuming that the positions of the sound-emitting units 3 with the respective sound-emitting surfaces 3S facing each other are defined as 0 degrees, the rotation range of each of the sound-emitting units 3 can be adjusted within the rotation angle range of 0 degrees to 90 degrees (inclusive). Thus, when a rotation angle of each of the sound-emitting units 3 is 0 degrees, the sound-emitting units 3 are set in the normal use state to be put on the right and left ears. Meanwhile, when the rotation angle of each of the sound-emitting units 3 is 90 degrees, the sound-emitting units 3 can be positioned with the respective sound-emitting surfaces 3S facing the same direction, improving the storability and portability of the headphone 1. Additionally, when the rotation angle is defined to be the second rotation range of not less than 0 degrees but less than 90 degrees, the headphone 1 can be worn with improved comfortableness.

The above arrangement can thus reliably improve the user-friendliness of the headphone 1.

The headphone 1 according to the first exemplary embodiment includes the headband 2, the sound-emitting units 3 each containing the speaker 32, the connectors 4 each provided to the headband 2 and configured to support the corresponding sound-emitting unit 3 such that the corresponding sound-emitting unit 3 is rotatable around the rotation axis along the up-down direction, and the adjusters 5 configured to adjust the position where the rotation of the corresponding sound-emitting unit 3 is restrictable. Among the above components, each of the adjusters 5 switches the rotation range of the corresponding sound-emitting unit 3 to one of the first rotation range and the second rotation range, switching the position where the rotation of the corresponding sound-emitting unit 3 is restrictable to one of the first restricting position and the second restricting position according to the first exemplary embodiment. This arrangement can achieve the same effects of the headphone 1 as described above.

Second Exemplary Embodiment

Next, a second exemplary embodiment of the invention will be described.

A headphone according to the second exemplary embodiment is structurally the same as the headphone 1 except that each of the adjusters is configured to define the rotation range of the corresponding sound-emitting unit (shaft) to be any range with respect to the reference position within a predetermined angle range. It should be noted that the same or substantially the same parts as already described will be denoted by the same reference characters hereinbelow for omission of the description thereof.

FIG. 10 schematically shows an adjuster 5A of the headphone according to the second exemplary embodiment and a rotation range of the shaft 36.

The headphone according to the second exemplary embodiment is structurally and functionally the same as the headphone 1 except that it includes the adjuster 5A in place of the adjuster 5.

The adjuster 5A is located in each of the connectors 4 (4R, 4L) provided to the right and left ends of the headband 2 to adjust the rotation range of the corresponding sound-emitting unit 3 in the same manner as the adjuster 5. As shown in FIG. 10, the adjuster 5A includes the fixed setting unit 51, a movable setting unit 52A, and an operation unit (not shown) configured to move the movable setting unit 52A in accordance with a user's operation.

It should be noted that the operation unit, which is structurally the same as the operation unit 54, includes the body 541 in the form of a dial and the rotation axis of the body 541 is coaxial with the rotation axis AX2 of the shaft 36.

The movable setting unit 52A is located in the recess 37 of the shaft 36 along with the fixed setting unit 51 at a position (level) different from that of the fixed setting unit 51 along the axial direction of the shaft 36. The movable setting unit 52A is moved along the circumferential direction of the shaft 36 (+D1 direction and −D1 direction) in accordance with the operation on the operation unit, thus defining the rotation range of the shaft 36.

Specifically, when the movable setting unit 52A is moved to a position aligned with the fixed setting unit 51, the rotation range of the shaft 36 is defined to be the first rotation range of 0 degrees to 90 degrees (inclusive) from the reference position, where the first fixed setting portion 511 of the fixed setting unit 51 comes into contact with the first edge 371, to the first restricting position, where the second fixed setting portion 512 comes into contact with the second edge 372.

Meanwhile, when the movable setting unit 52A is moved in the −D1 direction from the position aligned with the fixed setting unit 51, the second edge 372 comes into contact with the movable setting unit 52A as the shaft 36 is rotated in the +D1 direction, restricting a further rotation of the shaft 36 in the +D1 direction. In this case, the rotation range of the shaft 36 becomes smaller than the first rotation range to be defined as a range (second rotation range) between the reference position, where the first edge 371 comes into contact with the fixed setting unit 51, to the second restricting position, where the second edge 372 comes into contact with the movable setting unit 52A.

The position of the movable setting unit 52A in the recess 37 can be adjusted to any position by the user as desired. It should be noted that the movable setting unit 52A is movable into an area defined in the −D1 direction with respect to the setting unit 51 but not movable into an area in the +D1 direction beyond the fixed setting unit 51 in FIG. 10.

Effects of Second Exemplary Embodiment

The headphone according to the second exemplary embodiment as described above can achieve not only the same effects as those of the headphone 1 but also the following effects.

The adjuster 5A includes: the fixed setting unit 51 (first fixed setting portion 511) configured to come into contact with the first edge 371 of the recess 37 of the shaft 36 of the corresponding sound-emitting unit 3 to define the first end of the rotation range of the corresponding sound-emitting unit 3; and the movable setting unit 52A configured to come into contact with the second edge 372 of the recess 37 through movement along the circumferential direction (+D1 direction and −D1 direction) around the rotation axis AX2 of the shaft 36 to define the second end of the rotation range of the corresponding sound-emitting unit 3. This arrangement allows the rotation range of each of the sound-emitting units 3 to be defined as desired based on the position of the movable setting unit 52A, thus defining the position where the rotation of the sound-emitting unit 3 (shaft 36) is restricted so that the sound-emitting unit 3 is not further rotated as desired.

The adjuster 5A includes the operation unit that includes the body 541 in the form of a dial configured to move the movable setting unit 52A along the circumferential direction around the rotation axis AX2. The movable setting unit 52A can thus be easily set at a desired position by rotating the body 541. Additionally, since the rotation axis of the body 541 is coaxial with the rotation axis AX2 of the shaft 36, the user can intuitively define the rotation range. The rotation range can thus be easily defined.

Third Exemplary Embodiment

Next, a third exemplary embodiment of the invention will be described.

A headphone according to the third exemplary embodiment is structurally the same as the headphone 1 except that each of the adjusters is configured to define the rotation range of the corresponding sound-emitting unit (shaft) in increments of a predetermined angle. It should be noted that the same or substantially the same parts as already described will be denoted by the same reference characters hereinbelow for omission of the description thereof.

FIG. 11 schematically shows a structure of a shaft 36B and an adjuster 5B of the headphone according to the third exemplary embodiment. It should be noted that FIG. 11 shows that a second edge 53B2 of a later-described rotation restricting unit 52B is in contact with a second-end-setting portion 51B4.

The headphone according to the third exemplary embodiment is structurally and functionally the same as the headphone 1 except that it includes a sound-emitting unit 3B and the adjuster 5B in place of the sound-emitting unit 3 and the adjuster 5.

The sound-emitting unit 3B is structurally and functionally the same as the sound-emitting unit 3 except that the sound-emitting unit 3B includes the shaft 36B in place of the shaft 36. The shaft 36B, which is not illustrated in detail, projects upward from the support 35 (see FIG. 1) to be rotatably supported by the corresponding connector 4 in the same manner as the shaft 36. Unlike the shaft 36, the shaft 36B is not provided with the recess 37 as shown in FIG. 11. The shaft 36B is provided with, in place of the recess 37, the rotation restricting unit 52B with a later-described recess 53B.

The adjuster 5B is located in each of the connectors 4 (4R, 4L) provided to the right and left ends of the headband 2 to adjust the rotation range of the corresponding sound-emitting unit 3B in the same manner as the adjuster 5. The adjuster 5B includes a multistep setting unit 51B, the rotation restricting unit 52B, and an operation unit (not shown) as shown in FIG. 11.

Among the above components, the rotation restricting unit 52B, which is a cylindrical member with an outer circumferential surface that is partly provided with the recess 53B, is provided to the shaft 36B to be rotatable with the shaft 36B.

The recess 53B is formed along a circumferential direction of the shaft 36B, or a circumferential direction of the rotation restricting unit 52B, in the same manner as the recess 37 (see FIG. 6). The recess 53B has a first edge 53B1 facing the +D1 direction, which is configured to come into contact with a first-end-setting portion 51 B1 of the multistep setting unit 51B as the shaft 36B is rotated in the −D1 direction around the rotation axis AX2 along the up-down direction.

The second edge 53B2, which faces the −D1 direction, is configured to come into contact with one of second-end-setting portions 51B2 to 51B4 of the multistep setting unit 51B as the shaft 36B is rotated in the +D1 direction.

The user can move the rotation restricting unit 52B along an axial direction of the shaft 36B by operating the operation unit.

The multistep setting unit 51B includes the first-end-setting portion 51B1 and the plurality of second-end-setting portions 51B2 to 51B4, which are located in the recess 53B to define a rotation range of the shaft 36B. In the third exemplary embodiment, the multistep setting unit 51B includes the three second-end-setting portions 51 B2 to 51B4.

The first-end-setting portion 51B1 is configured to come into contact with the first edge 53B1 as described above. A position where the first-end-setting portion 51B1 comes into contact with the first edge 53B1 is defined as a reference position according to the third the exemplary embodiment, which corresponds to the normal use state of the corresponding sound-emitting unit 3 as shown in FIGS. 1 and 2.

The second-end-setting portions 51B2 to 51B4 are each arranged opposite to the first-end-setting portion 51B1 in the multistep setting unit 51B. The second-end-setting portions 51B2 to 51B4 are arranged in the recess 53B at different positions in the circumferential direction of the shaft 36B, while being arranged at different positions in the axial direction of the shaft 36B (aligned with the rotation axis AX2).

Specifically, the second-end-setting portion 51B2 is located further in the −D1 direction with respect to the first-end-setting portion 51B1, the second-end-setting portion 51B3 is located further in the −D1 direction with respect to the second-end-setting portion 51 B2, and the second-end-setting portion 51 B4 is located further in the −D1 direction with respect to the second-end-setting portion 51B3. It should be noted that the second-end-setting portions 51B3 and 51B4 are arranged in the −D1 direction every 22.5 degrees with respect to the position of the second-end-setting portion 51B2 being 0 degrees in the third exemplary embodiment.

Additionally, the second-end-setting portion 51B3 is located at a side around the axial direction of the shaft 36B with respect to the second-end-setting portion 51B2 and the second-end-setting portion 51B4 is located further at the same side with respect to the second-end-setting portion 51B3. It should be noted that the first-end-setting portion 51 B1 extends along the axial direction of the shaft 36B to be able to come into contact with the first edge 53B1 irrespective of the position (level) of the rotation restricting unit 52B.

Rotation Range of Sound-Emitting Unit

When the rotation restricting unit 52B is present at the same position (level) as the first-end-setting portion 51B1 and the second-end-setting portion 51B2 in the axial direction of the shaft 36B (i.e., the rotation restricting unit 52B is present within one of planes perpendicular to the axial direction where the first-end-setting portion 51 B1 and the second-end-setting portion 51 B2 are arranged), a rotation range of the rotation restricting unit 52B, or the rotation range of the shaft 36B (sound-emitting unit 3B), is from the reference position to a position (first restricting position) where the second edge 53B2 comes into contact with the second-end-setting portion 51B2. Such a rotation range is from 0 degrees to 90 degrees (inclusive) as defined between the reference position and the first restricting position. It should be noted that a state where the second-end-setting portion 51B2 is in contact with the second edge 53B2 corresponds to the storing state of the sound-emitting unit 3B shown in FIG. 3.

Meanwhile, when the rotation restricting unit 52B is present at the same position (level) as the first-end-setting portion 51B1 and the second-end-setting portion 51B3 in the axial direction of the shaft 36B, the rotation range of the shaft 36B (sound-emitting unit 3B) is from the reference position to a position (second restricting position) where the second edge 53B2 comes into contact with the second-end-setting portion 51B3. Such a rotation range is from 0 degrees to 67.5 degrees (inclusive) as defined between the reference position and the second restricting position.

Likewise, when the rotation restricting unit 52B is present at the same position (level) as the first-end-setting portion 51B1 and the second-end-setting portion 51B4 in the axial direction of the shaft 36B, the rotation range of the shaft 36B (sound-emitting unit 3B) is from the reference position to a position (third restricting position) where the second edge 53B2 comes into contact with the second-end-setting portion 51B4. Such a rotation range is from 0 degrees to 45 degrees (inclusive) between the reference position and the third restricting position.

Thus, by adjusting the position (level) of the rotation restricting unit 52B in the axial direction of the shaft 36B, the rotation range of the shaft 36B, or the rotation range of the sound-emitting unit 3B, can be adjusted to one of the range of 0 degrees to 45 degrees (inclusive), the range of 0 degrees to 67.5 degrees (inclusive), and the range of 0 degrees to 90 degrees (inclusive). It should be noted that the range of 0 degrees to 90 degrees (inclusive) according to the third exemplary embodiment corresponds to the first rotation range according to the invention, and the range of 0 degrees to 45 degrees (inclusive) and the range of 0 degrees to 67.5 degrees (inclusive) according to the third exemplary embodiment each correspond to the second rotation range of the invention.

Effects of Third Exemplary Embodiment

The headphone according to the third exemplary embodiment as described above can achieve not only the same effects as those of the headphone 1 but also the following effects.

The adjuster 5B includes: the first-end-setting portion 51B1 configured to define the first end of the rotation range of the corresponding sound-emitting unit 3B; the second-end-setting portions 51B2 to 51B4 arranged at the different positions (levels) in the axial direction of the shaft 36B (aligned with the rotation axis AX2) while being arranged at the different positions in the circumferential direction around the rotation axis AX2, the second-end-setting portions 51B2 to 51B4 being configured to define the second end of the rotation range of the corresponding sound-emitting unit 3B; and the rotation restricting unit 52B provided to the shaft 36B to be movable along the rotation axis AX2, the rotation restricting unit 52B being configured to come into contact with the first-end-setting portion 51B1 and one of the second-end-setting portions 51B2 to 51 B4 to restrict the rotation of the sound-emitting unit 3B around the rotation axis AX2. This arrangement allows the rotation restricting unit 52B to be moved along the rotation axis AX2 to the position (level) where the rotation restricting unit 52B comes into contact with one of the second-end-setting portions 51B2 to 51B4 to switch the rotation range of the corresponding sound-emitting unit 3B. The rotation range of the corresponding sound-emitting unit 3B can thus be reliably switched, thereby switching the position where the rotation of the corresponding sound-emitting unit 3B (shaft 36B) is restricted so that the corresponding sound-emitting unit 3B is not further rotated.

Modifications of Third Exemplary Embodiment

In the third exemplary embodiment, the rotation restricting unit 52B is moved along the axial direction of the shaft 36B to select one of the second-end-setting portions 51B2 to 51B4 that is to come into contact with the second edge 53B2 of the rotation restricting unit 52B. However, the invention is not limited thereto. The rotation restricting unit 52B may be integral with the shaft 36B and not be movable along the axial direction of the shaft 36B in the same manner as the shaft 36 according to the first and second exemplary embodiments. In other words, the shaft 36B and the rotation restricting unit 52B may be replaced by the shaft 36.

In this case, for instance, the multistep setting unit 51B may be configured to be movable along the axial direction without changing the position (level) of the recess in the axial direction to change the one of the second-end-setting portions 51B2 to 51B4 that is to come into contact with the edge of the recess.

Additionally, the second-end-setting portions 51B3, 51B4 may be projected with respect to the second-end-setting portion 51 B2 in response to the user's operation on the operation unit.

For instance, an alternative arrangement (not shown) may be employed where by operating the operation unit when the second-end-setting portions 51B3, 51B4 are present at the same position (level) as the second-end-setting portion 51B2 (when the rotation range of the shaft 36 is from 0 degrees to 90 degrees, inclusive), the second-end-setting portions 51B3, 51B4 (at least the second-end-setting portion 51B3) are projected to the second restricting position so that the second edge 372 comes into contact with the second-end-setting portion 51B3. In this case, the rotation range of the shaft 36 is from 0 degrees to 67.5 degrees (inclusive).

Moreover, by further operating the operation unit, the second-end-setting portion 51B4 may be projected to the third restricting position so that the second edge 372 comes into contact with the second-end-setting portion 51B4. In this case, the rotation range of the shaft 36 is from 0 degrees to 45 degrees (inclusive).

The adjuster with the above arrangement can also achieve the same effects as those of the headphone according to the third exemplary embodiment.

Fourth Exemplary Embodiment

Next, a fourth exemplary embodiment of the invention will be described.

A headphone according to the fourth exemplary embodiment is structurally the same as the headphone 1 except that the shaft, or the hanger, is engageable every predetermined angle within the rotation range. It should be noted that the same or substantially the same parts as already described will be denoted by the same reference characters hereinbelow for omission of the description thereof.

FIG. 12 schematically shows a structure of a sound-emitting unit 3C and an adjuster 5C of a headphone 1C according to the fourth exemplary embodiment.

The headphone 1C according to the fourth exemplary embodiment is structurally the same as the headphone 1 except that the headphone 1C includes the sound-emitting unit 3C and the adjuster 5C in place of the sound-emitting unit 3 and the adjuster 5.

The sound-emitting unit 3C is structurally the same as the sound-emitting unit 3 except that the sound-emitting unit 3C includes a shaft 36C in place of the shaft 36, the shaft 36C being provided with cuts 36C1 to 36C7 in addition to the recess 37.

The cuts 36C1 to 36C7 are formed at regular intervals along an outer circumferential surface of the shaft 36C. In the fourth exemplary embodiment, the cuts 36C1 to 36C7 are formed every 15 degrees around a center axis of the shaft 36C. A later-described insertion portion 5C1 of the adjuster 5C is to be received in one of the cuts 36C1 to 36C7.

The adjuster 5C is located in the corresponding connector 4 to adjust a rotation range of the shaft 36C and, consequently, a rotation range of the sound-emitting unit 3C in the same manner as the adjusters 5, 5A, 5B. The adjuster 5C includes the insertion portion 5C1 in the form of a projection and a biasing portion 5C2 in addition to the fixed setting unit 51 located in the recess 37 of the shaft 36C.

Among the above components, the biasing portion 5C2 is attached to an inner surface of the corresponding connector 4 to bias the insertion portion 5C1 toward the shaft 36C. The biasing portion 5C2 is an elastic member made of, for instance, a compression coil spring or rubber.

The insertion portion 5C1 is configured to be received in one of the cuts 36C1 to 36C7 to lock the shaft 36C, thus restricting the rotation of the shaft 36C. To allow the first edge 371 of the recess 37 to come into contact with the first fixed setting portion 511 (to set a rotation angle of the shaft 36C at 0 degrees), the insertion portion 5C1 is received in the cut 36C1, which is one of the cuts 36C1 to 36C7 that is located furthest in the +D1 direction. To allow the second edge 372 of the recess 37 to come into contact with the second fixed setting portion 512 (to set the rotation angle of the shaft 36C at 90 degrees), the insertion portion 5C1 is received in the cut 36C7, which is one of the cuts 36C1 to 36C7 that is located the furthest in the −D1 direction. To set the rotation angle of the shaft 36C at 45 degrees, the insertion portion 5C1 is received in the cut 36C4, which is the center one of the cuts 36C1 to 36C7.

FIG. 13 shows a rotation state of the sound-emitting unit 3C as viewed from above.

By inserting the above-described insertion portion 5C1 in one of the cuts 36C1 to 36C7, the shaft 36C is locked at a position as desired within the rotation range of 0 degrees to 90 degrees (inclusive) of the shaft 36C, where the fixed setting unit 51 comes into contact with one of the first and second edges 371, 372. The sound-emitting unit 3C is thus configured to rotate in the +D1 direction and the −D1 direction in increments of 15 degrees within the rotation range of 0 degrees to 90 degrees (inclusive) as shown in FIG. 13.

Additionally, when the insertion portion 5C1 is received in one of the cuts 36C1 to 36C7 by rotating the sound-emitting unit 3C, the user can feel a click. This helps the user to easily know the rotation angle of the sound-emitting unit 3C.

Effects of Fourth Exemplary Embodiment

The headphone 1C according to the fourth exemplary embodiment as described above can achieve the following effects.

The adjuster 5C includes the insertion portion 5C1 (locking portion) configured to lock the shaft 36C in increments of the predetermined angle (15 degrees in the fourth exemplary embodiment) along the circumferential direction around the rotation axis AX2 of the shaft 36C. The sound-emitting unit 3C can thus be locked in increments of the above angle by inserting the insertion portion 5C1 in one of the cuts 36C1 to 36C7 of the shaft 36C. This allows for easily angling the sound-emitting unit 3C as desired and reducing an accidental rotation of the sound-emitting unit 3C.

The adjuster 5C of the headphone 1C includes the fixed setting unit 51 located in the recess 37 and the fixed setting unit 51 is configured to come into contact with the first and second edges 371, 372 to define the rotation range of the sound-emitting unit 3C (shaft 36C). However, since the adjuster 5C includes the insertion portion 5C1, which serves as the locking portion, and the biasing portion 5C2, the fixed setting unit 51 may be omitted. It should be noted that the fixed setting unit 51 contributes to reducing an accidental rotation (turn) of the sound-emitting unit 3C by 360 degrees or more due to disengagement of the insertion portion 5C1 from one of the cuts 36C1 to 36C7.

Advantage(s) of Exemplary Embodiment(s)

Incidentally, it should be understood that the scope of the invention is not limited to the above-described exemplary embodiments but includes modifications and improvements that do not hamper the achievement of an object of the invention.

In the above exemplary embodiments, the rotation range of the sound-emitting unit is defined to be a range of 90 degrees or less with respect to the reference position being 0 degrees. However, the invention is not limited thereto but the maximum rotation angle of the sound-emitting unit can be changed as needed in some exemplary embodiments. Specifically, the maximum rotation angle of the sound-emitting unit exceeds 90 degrees (e.g., 180 degrees) in some exemplary embodiments. It should be noted that a rotation angle of the sound-emitting unit of 360 degrees or more would cause twist of the cord connected to the sound emitter located in the sound-emitting unit, so that the maximum rotation angle is preferably less than 360 degrees.

Meanwhile, when the sound-emitting unit is at the reference position, the headphone is in the normal use state. However, the invention is not limited thereto but a position of the sound-emitting unit corresponding to another state of the headphone is defined as the reference position in some exemplary embodiments.

Additionally, although the first fixed setting portion 511 of the fixed setting unit 51 and the first-end-setting portion 51B1 are not configured to move, they are configured to move in accordance with a user's operation on the operation unit in the same manner as the movable setting units 52, 52A in some exemplary embodiments.

In the first exemplary embodiment, the second rotation range is from 0 degrees to 45 degrees (inclusive) with respect to the reference position being 0 degrees. In the third exemplary embodiment, the second rotation range is from 0 degrees to 22.5 degrees (inclusive) with respect to the reference position of 0 degrees and the third rotation range is from 0 degrees to 45 degrees (inclusive). However, the invention is not limited thereto but the maximum angle within each rotation range can be changed to be any angle less than the maximum angle of the first rotation range as needed. For instance, the maximum angle of each angle range may fall within a range of 40 degrees to 60 degrees (inclusive). In this case, a user (e.g., DJ) can wear the headphone 1 in a state different from the normal state with the sound-emitting units 3 being fitted well to the user's body. The user can thus be less disturbed by one of the pair of sound-emitting units 3.

In the third exemplary embodiment, the multistep setting unit 51B includes the three second-end-setting portions 51B2 to 51B4, which are arranged at the different positions (levels) in the direction along the rotation axis AX2 while being arranged at the different positions in the circumferential direction around the rotation axis AX2. However, the invention is not limited thereto but the number of the second-end-setting portions can be changed as needed in some exemplary embodiments. Additionally, the angular intervals of the second-end-setting portions 51B2 to 51B4 can be changed from 22.5-degree intervals to any intervals, such as 15-degree intervals, as needed.

In the second exemplary embodiment, the movable setting unit 52A is configured to be moved to the predetermined position in the recess 37 for defining the first rotation range. In the fourth exemplary embodiment, one of the plurality of cuts 36C1 to 36C7 of the shaft 36C receives the insertion portion 5C1 to restrict the rotation of the shaft 36C. The above arrangement of the second exemplary embodiment and the above arrangement of the fourth exemplary embodiment are combined in some exemplary embodiments. For instance, an outer surface of the movable setting unit 52A is provided with an insertion portion in the form of a projection, recess members configured to receive the insertion portion are arranged every predetermined angle (e.g., 15 degrees) outside the movable setting unit 52A in accordance with the movement range of the movable setting unit 52A, and a biasing member is provided to bias these recess members toward the movable setting unit 52A in some exemplary embodiments. Such an arrangement allows the movable setting unit 52A to be moved using the operation unit with a click feeling and the movable setting unit 52A to be locked after moved.

In the fourth exemplary embodiment, the shaft 36C of the sound-emitting unit 3C is provided with the cuts 36C1 to 36C7 arranged every 15 degrees around the center axis of the shaft 35C and one of the cuts 36C1 to 36C7 receives the insertion portion 5C1 (locking portion) to restrict the rotation of the shaft 36C and, consequently, the rotation of the sound-emitting unit 3C. However, the invention is not limited thereto but the formation intervals (formation angle) and/or the number of the cuts can be changed as needed in some exemplary embodiments. For instance, the cuts are formed every 20 degrees in some exemplary embodiments.

In the above exemplary embodiments, the sound-emitting units 3, 3B, 3C each include the hanger 34 supporting the housing 31 and including corresponding one of the shafts 36, 36B, 36C engageable with corresponding one of the adjusters 5, 5A, 5B, 5C. However, the invention is not limited thereto but the sound-emitting unit does not include the hanger supporting the housing such that the housing is rotatable while connected to the connector provided to the headband in some exemplary embodiments. In this case, the shaft 36, 36B or 36C of the sound-emitting unit may be located at any position in the sound-emitting unit. For instance, the shaft is provided to the housing and the housing is directly connected to the connector and, consequently, the headband in some exemplary embodiments.

In the above exemplary embodiments, the sound-emitting units 3, 3B, 3C, the connectors 4, and the adjusters 5, 5A, 5B, 5C are provided at the right and left of the headband 2, respectively. In other words, the headphone includes the headband, the pair of sound-emitting units, the pair of connectors, and the pair of adjusters. However, the invention is not limited thereto but the sound-emitting unit, the connector and the adjuster are provided at only one of the right and left of the headband or, alternatively, only the adjuster is provided at only one of the right and left of the headband in some exemplary embodiments.

The invention claimed is:

1. A headphone comprising: a headband; at least one sound-emitting unit comprising a sound emitter located therein; at least one connector connecting the sound-emitting unit to the headband such that the sound-emitting unit is rotatable around a rotation axis along an up-down direction; and at least one adjuster configured to adjust a rotation range of the sound-emitting unit, wherein the adjuster is configured to switch the rotation range to one of a first rotation range and a second rotation range.

2. The headphone according to claim 1, wherein the adjuster comprises: a first fixed setting portion configured to come into contact with the sound-emitting unit to define respective first ends of the first rotation range and the second rotation range; a second fixed setting portion configured to come into contact with the sound-emitting unit to define a second end of the first rotation range; a movable setting unit configured to come into contact with the sound-emitting unit to define a second end of the second rotation range; and a switcher configured to move the movable setting unit to switch the rotation range to one of the first rotation range and the second rotation range.

3. The headphone according to claim 2, wherein the sound-emitting unit further comprises a shaft along the rotation axis, the shaft has an outer circumferential surface provided with a recess that is recessed radially inward, the first fixed setting portion and the second fixed setting portion are located in the recess such that the first fixed setting portion and the second fixed setting portion are to come into contact with first edge and second edge of the recess, respectively, and the movable setting unit is moved in and out of the recess with use of the switcher.

4. The headphone according to claim 3, wherein the switcher comprises a slide member configured to move the movable setting unit in a direction perpendicular to the rotation axis.

5. The headphone according to claim 1, wherein the adjuster comprises:

a fixed setting unit configured to come into contact with the sound-e unit to define a first end of the rotation range; and a movable setting unit configured to be moved along a circumferential direction around the rotation axis and come into contact with the sou nd-e ittin unit to define a second end of the rotation range.

6. The headphone according to claim 5, wherein the adjuster comprises a dial configured to move the movable setting unit along the circumferential direction around the rotation axis.

7. The headphone according to claim 1, wherein the adjuster comprises: a first-end-setting portion configured to define a first end of the rotation range; a plurality of second-end-setting portions arranged at different positions in a direction along the rotation axis while being arranged at different positions in a circumferential direction around the rotation axis, the plurality of second-end-setting portions being configured to define a second end of the rotation range; and a rotation restricting unit provided to the sound-emitting unit to be movable along the rotation axis, the rotation restricting unit being configured to come into contact with one of the first-end-setting portion and the plurality of second-end-setting portions to restrict rotation of the sound-emitting unit around the rotation axis.

8. The headphone according to claim 1, wherein the adjuster comprises a locking portion configured to engage the sound-emitting unit at each predetermined angle along the circumferential direction around the rotation axis.

9. The headphone according to claim 1, wherein the at least one sound-emitting unit comprises a pair of sound-emitting unit, the at least one connector comprises a pair of connectors, and at least one the adjuster comprises a pair of adjusters, respective sound-emitting surfaces of the pair of sound-emitting units face each other at positions defined as 0 degrees and the rotation range is adjustable within a rotation angle range of 0 degrees to 90 degrees (inclusive).

10. A headphone comprising: a headband; a sound-emitting unit comprising a sound emitter located therein; a connector provided to the headband, the connector supporting the sound-emitting unit such that the sound-emitting unit is rotatable around a rotation axis along an up-down direction; and an adjuster configured to adjust a position where rotation of the sound-emitting unit is restricted, wherein the adjuster is configured to switch the rotation range to one of a first rotation range and a second rotation range smaller than the first rotation range.

* * * * *